US009931646B2

(12) United States Patent
Isaksson et al.

(10) Patent No.: US 9,931,646 B2
(45) Date of Patent: Apr. 3, 2018

(54) CENTRIFUGAL SEPARATOR HAVING A FORCING DEVICE TO CREATE A RADIAL LEAK FLOW

(75) Inventors: Roland Isaksson, Grödinge (SE); Peter Thorwid, Sundbyberg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 425 days.

(21) Appl. No.: 14/343,531

(22) PCT Filed: Aug. 31, 2012

(86) PCT No.: PCT/EP2012/066955

§ 371 (c)(1),
(2), (4) Date: Apr. 22, 2014

(87) PCT Pub. No.: WO2013/034495

PCT Pub. Date: Mar. 14, 2013

(65) Prior Publication Data

US 2014/0235422 A1 Aug. 21, 2014

(30) Foreign Application Priority Data

Sep. 8, 2011 (EP) ..... 11180499

(51) Int. Cl.
*B04B 1/00* (2006.01)
*B04B 1/08* (2006.01)
(Continued)

(52) U.S. Cl.
CPC ..... *B04B 11/00* (2013.01); *B04B 1/00* (2013.01); *B04B 1/08* (2013.01); *B04B 7/00* (2013.01); *B04B 9/04* (2013.01); *B04B 11/02* (2013.01)

(58) Field of Classification Search
CPC .. B04B 1/00; B04B 1/08; B04B 11/00; B04B 9/04; B04B 7/00
(Continued)

(56) References Cited

U.S. PATENT DOCUMENTS 2,139,715 A 12/1938 Bergner
2,222,727 A 11/1940 Stigen
(Continued)

FOREIGN PATENT DOCUMENTS

CA 2368176 A1 10/2000
CN 2194765 Y 4/1995
(Continued)

*Primary Examiner* — Walter D Griffin
*Assistant Examiner* — Shuyi S Liu
(74) *Attorney, Agent, or Firm* — Birch, Stewart, Kolasch & Birch, LLP

(57) ABSTRACT

A centrifugal separator includes a frame and a rotating part including a spindle and a centrifuge rotor enclosing a separation space. An inlet channel provides fluid communication into the separation space and includes a rotary channel part, a frame channel part, and a first seal at the interface between the rotary and frame channel parts. An outlet channel provides fluid communication out from the separation space and includes a rotary channel part, a frame channel part, and a second seal at the interface between the rotary and frame channel parts. The inlet and outlet channels are arranged concentrically with each other. A forcing device is provided to generate a leak flow through one of the first and second seals in a first direction from the outlet channel to the inlet channel and to counteract leakage in the opposite direction.

19 Claims, 5 Drawing Sheets

(51) Int. Cl.

| | |
|---|---|
| ***B04B 7/00*** | (2006.01) |
| ***B04B 9/04*** | (2006.01) |
| ***B04B 11/00*** | (2006.01) |
| ***B04B 11/02*** | (2006.01) |

(58) Field of Classification Search
USPC ..... 494/41, 50, 65, 79, 83, 84
See application file for complete search history.

(56) References Cited

U.S. PATENT DOCUMENTS

| | | | | |
|---|---|---|---|---|
| 2,837,273 | A * | 6/1958 | Sullivan | B04B 1/08 494/27 |
| 2,906,449 | A | 9/1959 | Sullivan | |
| 3,117,928 | A | 1/1964 | Thylefors | |
| 3,189,268 | A | 6/1965 | Nilsson | |
| 3,640,452 | A | 2/1972 | Thylefors | |
| 4,759,744 | A * | 7/1988 | Krook | B04B 11/02 494/10 |
| 6,176,820 | B1 | 1/2001 | Westerberg | |
| 6,319,186 | B1 * | 11/2001 | Pitkamaki | B04B 1/08 494/27 |
| 6,802,804 | B1 | 10/2004 | Stroucken | |
| 6,955,637 | B1 | 10/2005 | Montano et al. | |
| 2007/0024979 | A1 | 2/2007 | Lissotschenko et al. | |
| 2007/0249479 | A1 * | 10/2007 | Eliasson | B01D 45/14 494/43 |
| 2009/0186752 | A1 * | 7/2009 | Isaksson | B01D 45/14 494/40 |

FOREIGN PATENT DOCUMENTS

| | | | | |
|---|---|---|---|---|
| CN | 1250397 | A | 4/2000 | |
| CN | 101628261 | A | 1/2010 | |
| EP | 0037210 | A1 * | 10/1981 | F16J 15/006 |
| EP | 0037210 | A1 | 10/1981 | |
| GB | 616442 | A | 1/1949 | |
| GB | 834923 | A | 5/1960 | |
| RU | 2233709 | C2 | 8/2003 | |
| WO | WO 2007/133161 | A1 | 11/2007 | |

* cited by examiner

CENTRIFUGAL SEPARATOR HAVING A FORCING DEVICE TO CREATE A RADIAL LEAK FLOW

TECHNICAL FIELD OF THE INVENTION

The present invention refers to a centrifugal separator according to the preamble of claim 1, see U.S. Pat. No. 4,759,744.

PRIOR ART

The centrifugal separator disclosed in U.S. Pat. No. 4,759,744 comprises a frame (illustrated as stationary members), and a rotating part comprising a spindle and a centrifuge rotor enclosing a separation space. The rotating part is supported by the frame to rotate around an axis of rotation. A drive member (not shown in the drawing) rotates the rotating part. An inlet channel provides fluid communication into the separation space and comprises a rotary channel part attached to the centrifuge rotor, a frame channel part attached to the frame, and sealing means provided at the interface between the rotary channel part of the inlet channel and the frame channel part of the inlet channel. An outlet channel provides fluid communication out from the separation space and comprises a rotary channel part attached to the centrifuge rotor, a frame channel part attached to the frame, and sealing means provided at the interface between the rotary channel part of the outlet channel and the frame channel part of the outlet channel. A further outlet channel provides fluid communication out from the separation space and comprises a rotary channel part attached to the centrifuge rotor, a frame channel part attached to the frame, and sealing means provided at the interface between the rotary channel part of the further outlet channel and the frame channel part of the further outlet channel.

In centrifugal separators, such as the one disclosed in U.S. Pat. No. 4,759,744, it is important that the sealing means ensures that no leakage can occur. Leakage from the inlet channel into one of the outlet channels will severely reduce the efficiency of the centrifugal separator, and can under certain circumstances destroy one of the separated products. Consequently, the costs for the sealing means and for the maintenance of the sealing means are significant.

Furthermore, in centrifugal separators, such as the one disclosed in U.S. Pat. No. 4,759,744 where all bearings and the drive motor are positioned on the spindle side, there is a difficulty to ensure a proper functioning of the sealings of the communication channels at the side of the centrifuge rotor turned away from the spindle. This is due the to pivoting of the spindle and the centrifuge rotor during operation of the centrifugal separator. These sealings require a complex design since they have to provided a proper sealing of movements in several directions.

WO 2007/133161 discloses another centrifugal separator comprising a frame and a rotating part comprising a spindle and a centrifuge rotor enclosing a separation space. The rotating part is supported by the frame to rotate around an axis of rotation. An inlet channel, comprising a rotary channel part attached to the centrifuge rotor, provides fluid communication into the separation space. An outlet channel, comprising a rotary channel part attached to the centrifuge rotor, provides fluid communication out from the separation space. A possible further outlet channel provides fluid communication out from the separation space.

EP-B-37210 discloses a mechanical seal with two pairs of opposite seal surfaces. One seal surface in one of the pairs is provided with spiral pumping grooves for forcing a medium in one determined direction through the seal between the opposite seal surfaces.

SUMMARY OF THE INVENTION

The object of the present invention is to overcome the problems discussed above, and to provide a centrifugal separator, that may ensure a high separation efficiency, low costs for the sealing means and low maintenance costs.

This object is achieved by the centrifugal separator initially defined, which is characterized in that the inlet channel and the outlet channel are arranged adjacent to and concentrically with each other, and that forcing means are provided to generate a leak flow through one of the sealing means in a first direction from the outlet channel to the inlet channel and thus to counteract, or prevent, leakage in the opposite direction from the inlet channel to the outlet channel.

With such an arrangement of the inlet and outlet channels and the forcing means, it is possible to counteract or prevent leakage of the product fed to the separation space into the separated product leaving the separation space. A low degree of impurities in the separated product is thus achieved. Furthermore, the arrangement of the inlet and outlet channels adjacent to each other makes it possible to let all communication channels enter the separation space from one side, for instance through the spindle, thereby leaving the other side free with only one or completely from communication channels into or out from the centrifuge rotor and the separation space. Such an arrangement enables a very compact design of the centrifugal separator, where at least most of the sealing means and bearings may be provided on one side of the centrifuge rotor, which simplifies the design and construction of the centrifugal separator.

According to an embodiment of the invention, the inlet channel is configured to feed a product to be separated into the separation space and the outlet channel is configured to discharge a separated primary phase of the product from the separation space, wherein the forcing means are provided to generate said leak flow from the outlet channel to the inlet channel and thus to counteract, or prevent, leakage from the inlet channel to the outlet channel, i.e. into the primary phase of the separated product.

According to a further embodiment of the invention, the forcing means are comprised by said one of the sealing means. Advantageously, at least said one of the sealing means may then comprise a rotary seal surface on the respective rotary channel part and a frame seal surface on the respective frame channel part, and wherein the rotary seal surface and the frame seal surface are arranged opposite to each other. A small gap may be provided between the rotary seal surface and the opposite frame seal surface. Advantageously, the rotary seal surface and the frame seal surface both extend in parallel with a radial plane with respect to the axis of rotation.

According to a further embodiment of the invention, the forcing means comprises a plurality of at least partly non-radial pumping elements on at least one of the rotary seal surface and the frame seal surface. The pumping elements may comprises blades projecting from at least one of the rotary seal surface and the frame seal surface, or grooves in at least one of the rotary seal surface and the frame seal surface. Advantageously, the pumping elements may have a curved shape seen in the direction of the axis of rotation.

According to a further embodiment of the invention, the forcing means may be configured to generate an overpressure in the outlet channel with respect to the inlet channel, at least in an area around said one of the sealing means. Normally, centrifugal separators, in particularly with a closed separation space, i.e. of a so called hermetic type, are operated with an overpressure in the inlet channel with respect to the outlet channel.

According to a further embodiment of the invention, the forcing means may comprise a pump wheel provided to operate on the outlet channel and arranged to force the fluid communication through the outlet channel, and thus to generate said leak flow. The pump wheel may be located upstream said one of the sealing means. The pump wheel may be driven by means of a turbine wheel provided in the inlet channel. The pump wheel provides an example of advantageous forcing means for providing such an overpressure in the outlet channel.

According to a further embodiment of the invention, the spindle comprises the rotary channel part of the inlet channel and the rotary channel part of the outlet channel. Consequently, both the inlet channel and the outlet channel extend through the spindle, enabling a compact design of the centrifugal separator as mentioned above.

According to a further embodiment of the invention, the drive member comprises an electrical motor having a rotor and a stator, wherein the rotor is fixedly connected to the rotating part. Advantageously, the rotor of the electrical motor may be provided on or fixed to the spindle.

According to a further embodiment of the invention, the outlet channel is provided within the inlet channel. This is advantageous with respect to the energy consumption since the outlet flow may be provided at a smaller radius than the inlet flow.

According to a further embodiment of the invention, the inlet channel is provided within the outlet channel.

According to a further embodiment of the invention, the centrifugal separator comprises a further outlet channel configured to provide fluid communication out from the separation space and comprising a rotary channel part attached to the centrifuge rotor, a frame channel part attached to the frame, and sealing means provided at the interface between the rotary channel part and the frame channel part. Advantageously, the further outlet channel may be configured to discharge a separated secondary phase of the product from the separation space, wherein the forcing means are provided to generate a leak flow through the sealing means of the inlet channel from the further outlet channel into the inlet channel and thus to counteract, or prevent, leakage from the inlet channel into the further outlet channel.

According to a further embodiment of the invention, the outlet channel is provided within the inlet channel, wherein the inlet channel is provided within the further outlet channel at least at the interface between the rotary channel part of the inlet channel and the frame channel part of the inlet channel, and wherein the forcing means are provided to generate a leak flow through the sealing means of the inlet channel from the further outlet channel into the inlet channel and thus to counteract, or prevent leakage from the inlet channel into the further outlet channel. Advantageously, the rotary channel parts of the inner outlet channel, the intermediate inlet channel and the outer further outlet channel are all contained or comprised in the spindle. This embodiment is especially advantageous due to the possibility of complete dispense with any communication channels through the casing at the side turned away from the spindle.

BRIEF DESCRIPTION OF THE DRAWINGS

The present invention will now be explained more closely by means of a description of various embodiments and with reference to the drawings attached hereto.

DETAILED DESCRIPTION OF VARIOUS EMBODIMENTS OF THE INVENTION

Figure 1:
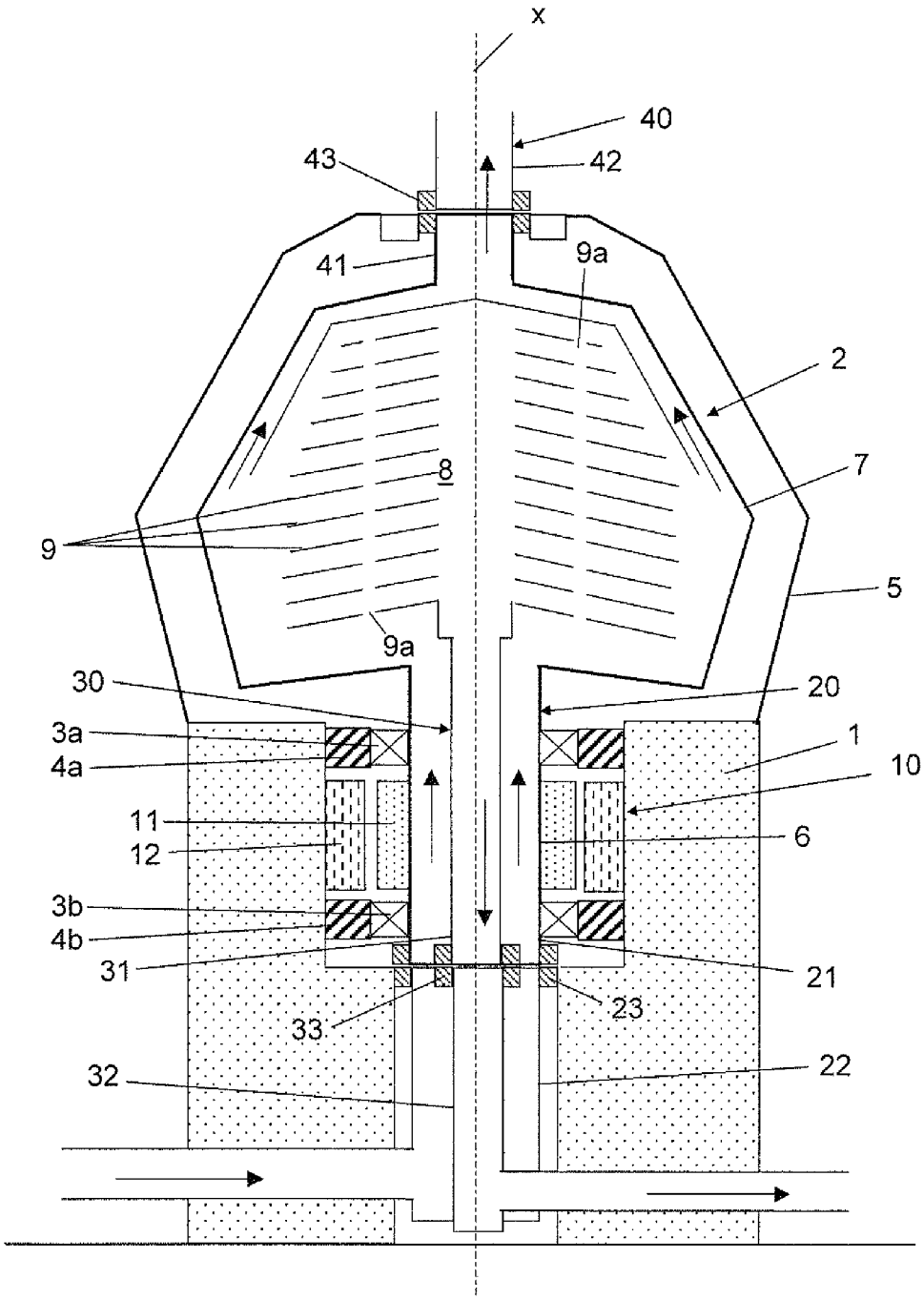
FIG. 1 discloses a centrifugal separator according to a first embodiment of the invention.

FIG. 1 discloses a centrifugal separator according to a first embodiment comprising a frame 1 and a rotating part 2. The rotating part 2 is rotatably supported by the frame 1 to rotate around an axis x of rotation by means of suitable bearing means, for instance in the form of one or more bearings. In the first embodiment the bearing means comprises a first bearing 3*a*, and a second bearing 3*b*. The first and second bearings 3*a*, 3*b* may comprise roller bearings or ball bearings. The first bearing 3*a* may be elastically mounted to the frame 1 via a first resilient member 4*a* having suitable elastic and damping properties. Also the second bearing 3*b* may be elastically mounted to the frame 1 via a second resilient member 4*b* having suitable elastic and damping properties.

The frame 1 may be stationary, at least with respect to the rotating part 2. For instance, the frame 1 may be located or mounted on the ground, possibly via an intermediate fundament that may be provided with damping means or configured to provide a damping function of vibrations or other movements of the centrifugal separator. The frame 1 comprises or carries a casing 5.

The rotating part 2 comprises a spindle 6 and a centrifuge rotor 7 attached to the spindle 6. The centrifuge rotor 7 is enclosed by the casing 5. The centrifuge rotor 7 encloses or defines a separation space 8. The centrifuge rotor 7 also comprises a plurality or a large number of separation discs 9 provided in separation space 8. In the embodiments disclosed, the separation discs 9 are conical. However, as an alternative radial or even axial separation discs may be comprised by the centrifuge rotor 7. The centrifugal separator of the embodiments disclosed is of a so called hermetic type with a closed separation space 8.

The centrifugal separator also comprises a drive member 10 for rotating the rotating part 2. The drive member 10 comprises, in the embodiments disclosed, an electric motor directly attached to the spindle 6. The electric motor comprises a rotor 11, which is attached to and extends around the spindle 6, and a stator 12, which is attached to the frame 1. Alternatively, the drive member 10 may be provided beside the spindle 6 and rotate the rotating part 2 via a suitable transmission, such as a belt or a gear transmission.

In the embodiments disclosed, the first bearing 3*a* and the second bearing 3*b* are attached to the spindle 6 and provided on a respective side of the drive member 10. The first bearing 3*a* is provided on the spindle 6 between the drive member 10 and the centrifuge rotor 7, whereas the second bearing 3*b* is provided on the spindle 6 on the other side of the drive member 10 turned away from the centrifuge rotor 7.

The centrifugal separator comprises an inlet channel 20, an outlet channel 30 and a further outlet channel 40.

The inlet channel 20 is configured to provide fluid communication into the separation space 8 and to feed a product to be separated into the separation space 8. The inlet channel 20 comprises a rotary channel part 21 having an inner and outer surface, the rotary channel part attached to the centrifuge rotor 7, a frame channel part 22 having an inner and outer surface, the frame channel part attached to the frame 1, and sealing means 23 provided at the interface between the rotary channel part 21 of the inlet channel 20, and the frame channel part 22 of the inlet channel 20. The sealing means 23 contacts the outer surface of the rotary channel part 21 and frame channel part 22.

The outlet channel 30 is configured to provide fluid communication out from the separation space 8 and to discharge a separated primary phase of the product from the separation space 8. The outlet channel 30 comprises a rotary channel part 31 having an inner and outer surface, the rotary channel part attached to the centrifuge rotor 7, a frame channel part 32 having an inner and outer surface, the frame channel part attached to the frame 1, and sealing means 33 provided at the interface between the rotary channel part 31 of the outlet channel 30, and the frame channel part 32 of the outlet channel 30. The sealing means 33 contacts the outer surface of the rotary channel part 31 and frame channel part 32.

The further outlet channel 40 is configured to provide fluid communication out from the separation space 8 and to discharge a separated secondary phase of the product from the separation space 8. The further outlet channel 40 comprises a rotary channel part 41 attached to the centrifuge rotor 7, a frame channel part 42 attached to the frame 1, and sealing means 43 provided at the interface between the rotary channel part 41 of the further outlet channel 40, and the frame channel part 42 of the further outlet channel 40.

In addition, the centrifugal separator may comprises a plurality of outlet openings, not disclosed in the figures, provided at the outer periphery of the centrifuge rotor 7 for discharge of a sludge or another further product from the separation space 8. The openings may be permanently open or intermittently openable by means of a valve mechanism as known in the prior art.

Furthermore, each of the separation discs 9 may be provided with one or more feed holes 9*a* through which the product entering the separation space 8 may be fed into the package of separation discs 9 and distributed onto the separation discs 9.

In the embodiment disclosed in FIG. 1, the primary phase of the product is a relatively light phase whereas the secondary phase of the product is a relatively heavy phase. Furthermore, the primary phase is the minor phase whereas the secondary phase is the main phase. These conditions may of course be the opposite in various variants of the first embodiment disclosed.

The inlet channel 20 and the outlet channel 30 are arranged adjacent to and concentrically with each other. In the first embodiment, the outlet channel 30 is provided within the inlet channel 20. It is of course possible, as an alternative solution, to provide the inlet channel 20 within the outlet channel 30.

The centrifugal separator also comprises forcing means provided to generate a leak flow through one of the sealing means, in the first embodiment the sealing means 33 of the outlet channel 30, in a first direction from the outlet channel 30 to the inlet channel 20, and thus to counteract or prevent leakage in the opposite direction from the inlet channel 20 to the outlet channel 30. As the inlet channel 20 and outlet channel are concentrically arranged, leak flow through the sealing means 33 is in the radial direction.

Figure 2:
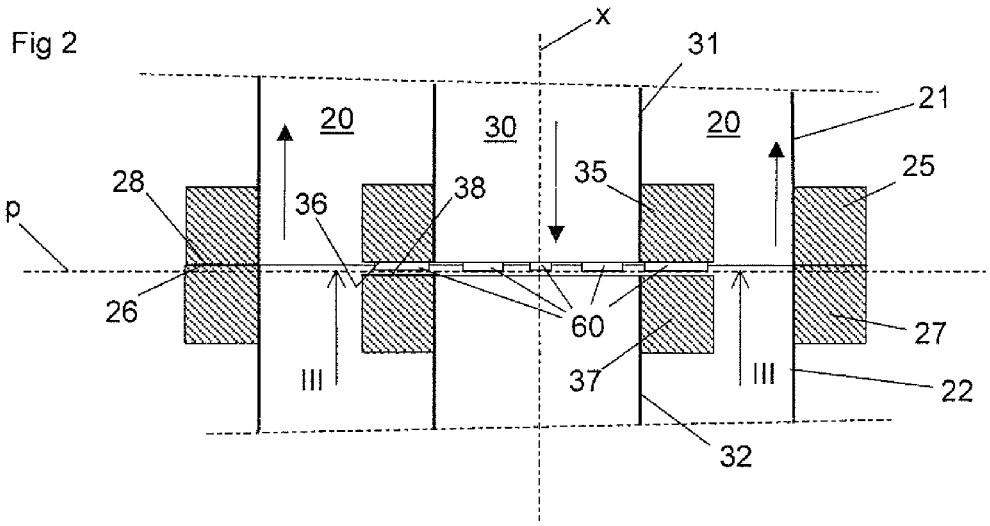
FIG. 2 discloses a longitudinal section of sealing means of the centrifugal separator in FIG. 1.
Figure 3:
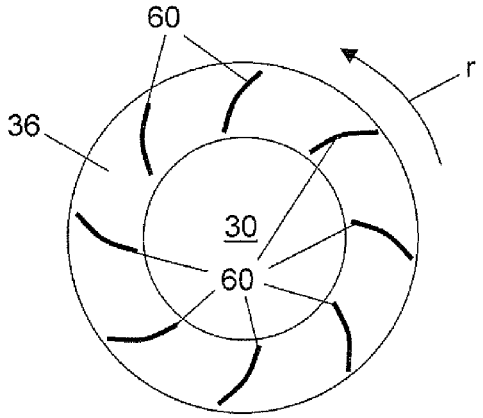
FIG. 3 discloses a view along the line III-III in FIG. 2.
Figure 4:
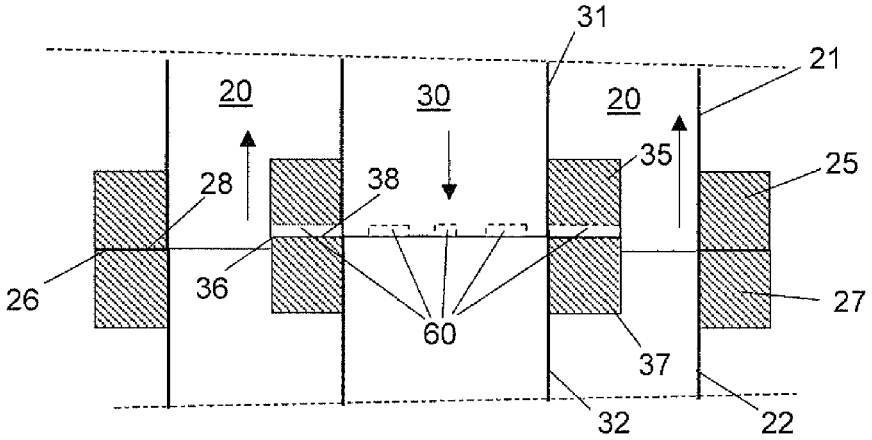
FIG. 4 discloses a longitudinal section of a variant of sealing means of the centrifugal separator in FIG. 1.

The sealing means 23, 33 and 43 comprise a respective rotary seal element 25, 35 and 45 attached to the respective rotary channel part 21, 31 and 41, and provided with a respective rotary seal surface 26, 36 and 46, see also FIGS. 2-4. The sealing means 23, 33 and 43 also comprise and a respective frame seal element 27, 37 and 47 attached to the respective frame channel part 22, 32 and 42 and provided with a respective frame seal surface 28, 38 and 48. The rotary seal surfaces 26, 36 and 46 are arranged opposite to the respective frame seal surface 28, 38 and 48. The rotary seal surfaces 26, 36 and 46 and the frame seal surfaces 28, 38, 48 are all plane and extend in parallel with a radial plane p with respect to the axis x of rotation. The rotary seal surfaces 26, 36 and 46 may be arranged to abut the respective frame seal surface 28, 38 and 48 for the rotary seal surface 26, as indicated in FIGS. 2 and 4, and frame seal surface 28, and for the rotary seal surface 36 and frame seal surface 36, as indicated in FIG. 2. These abutting seal surfaces form a so called mechanical seal.

However, it is also possible to arrange the rotary seal surfaces 26, 36 and 46 at a small distance to the respective frame seal surface 28, 38 and 48, leaving a gap, or a thin gap, therebetween as indicated in FIG. 2 for the rotary seal surface 36 and the frame seal surface 38. Such a gap will permit the leak flow mentioned above.

In the first embodiment, the forcing means comprises a plurality of at least partly non-radial pumping elements 60 on at least one of the rotary seal surface 26, 36 and 46 and the frame seal surface 28, 38 and 48. In the embodiment disclosed in FIGS. 1-4, the pumping elements 60 are provided on the rotary seal surface 36 of the rotary channel part 30 of the outlet channel 30. It is to be understood, that the pumping elements 60 alternatively may be provided on the frame seal surface 28, 38, 48, or possibly on both the rotary seal surface 26, 36, 46 and the frame seal surface 28, 38, 48.

In FIGS. 2 and 3, the pumping elements 60 are configured as blades projecting from the rotary seal surface 36. In FIG. 2 the pumping elements 60 are configured in such a way that the blades do not abut the opposite frame seal surface 38. However, it is to be understood that it is possible to let the pumping elements 60 extend so that the blades will abut the opposite frame seal surface 38.

As can be seen in FIG. 3, the pumping elements 60 extend in a non-radial direction. More precisely, the pumping elements 60 extend outwardly and rearwardly with respect to the rotary direction r of the rotary seal surface 60 seen in the direction of the axis x of rotation.

As also illustrated in FIG. 3, the pumping elements 60 have a curved shape seen in the direction of the axis x of rotation. It is to be noted that the pumping elements 60 instead may have a straight non-radial extension seen in the direction of the axis x of rotation.

In the first embodiment, eight such pumping elements 60 are provided. It is to be noted that the number of pumping elements 60 may be less or more than eight, for instance 2-7 or 9 or more.

In FIG. 4, the pumping elements 60 are, instead of comprising blades, configured as or comprising grooves formed in the rotary seal surface 36. In this variant of the pumping elements 60, the grooves may advantageously extend beyond the inner and outer side surfaces of the rotary seal element 35. Furthermore, the rotary seal surface 36 may, but does not have to, abut the frame seal surface 38 as illustrated in EP-B-37210.

Figure 5:
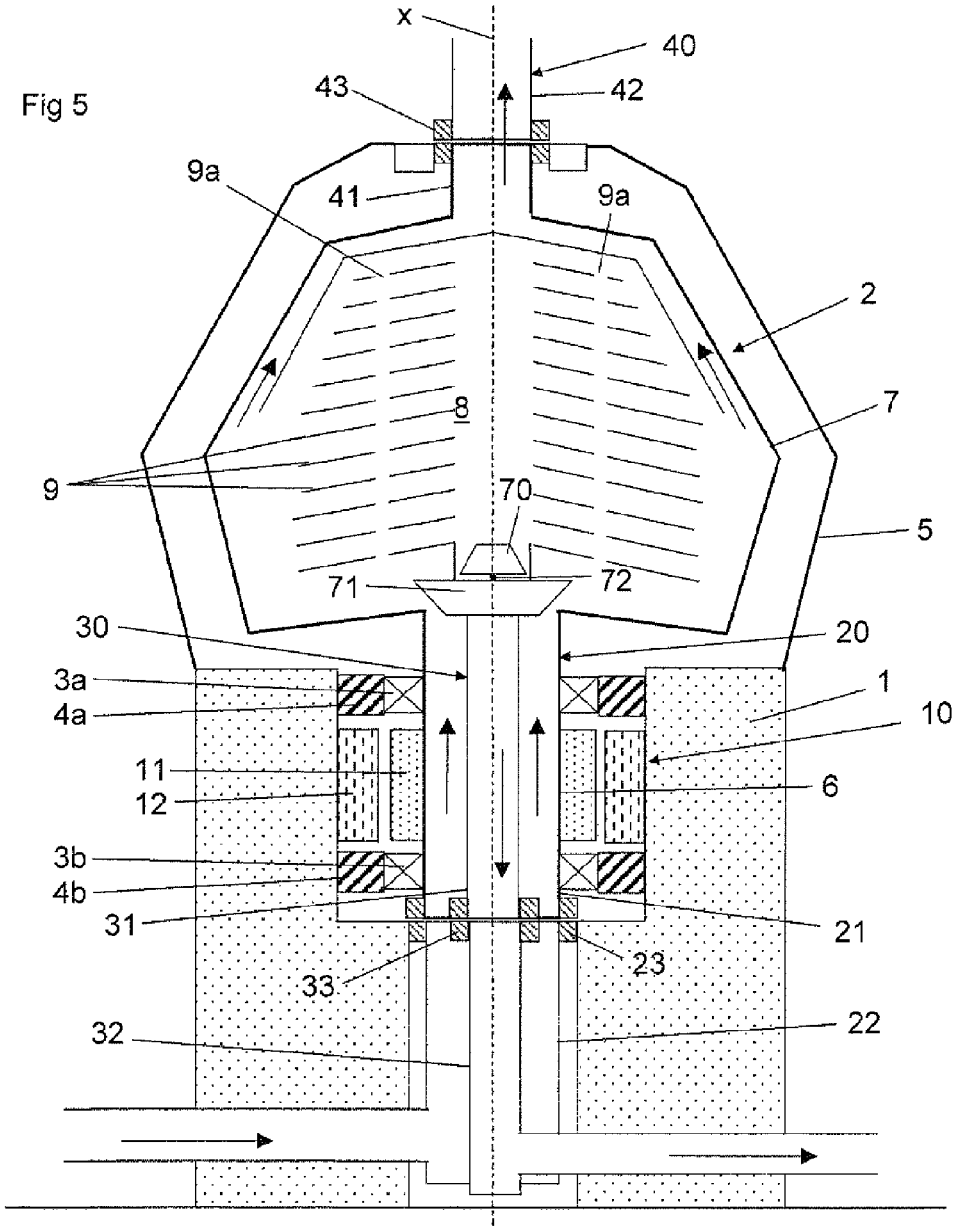
FIG. 5 discloses a centrifugal separator according to a second embodiment of the invention.
Figure 6:
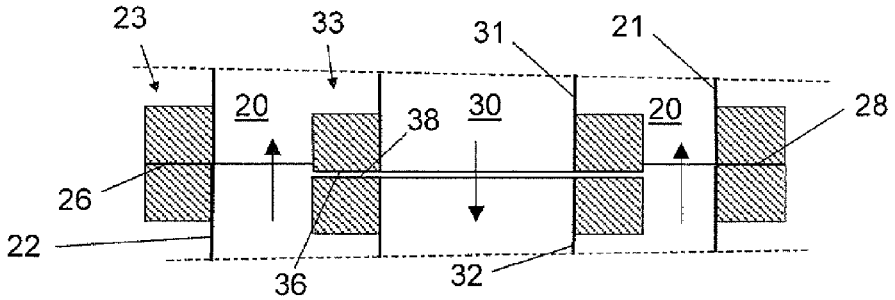
FIG. 6 discloses sealing means of the centrifugal separator in FIG. 5.

FIG. 5 discloses a second embodiment of the centrifugal separator, which differs from the first embodiment in that the forcing means comprises a pump wheel 70 provided in or at the outlet channel 30. The pump wheel 70 is and arranged to promote the fluid communication from the separation space 8, and thus to force the fluid, i.e. the separated primary phase, through the outlet channel 30. In such a way the leak flow through the sealing means 33 of the outlet channel 30 will be generated. The pump wheel 70 is located upstream the sealing means 33 of the outlet channel 30.

In the second embodiment, the pump wheel 70 is driven by a turbine wheel 71 via a drive shaft 72. The turbine wheel 71 is provided in the inlet channel 20 and driven by the fluid flow of the product fed through the inlet channel 20 into the separation space. However, as an alternative to the turbine wheel 71, the pump wheel 70 may be driven by an electrical motor via the drive shaft 72, or via a magnetic coupling, whereby the electrical motor may be provided inside or outside the rotating part 2.

In the second embodiment it may be dispensed with the pumping elements 60. The pumping effect of the pump wheel 70 may be sufficient to force a small part, i.e. the leak flow, of the primary phase through the sealing means 33. However, it is to be noted that the pump wheel 70 may be combined with pumping elements 60.

In the second embodiment, the rotary seal surface 36 and frame seal surface 38 of the outlet channel 30 are provided at a small distance from each other, i.e. with a gap therebetween, in order to permit the above mentioned leak flow therethrough.

Figure 7:
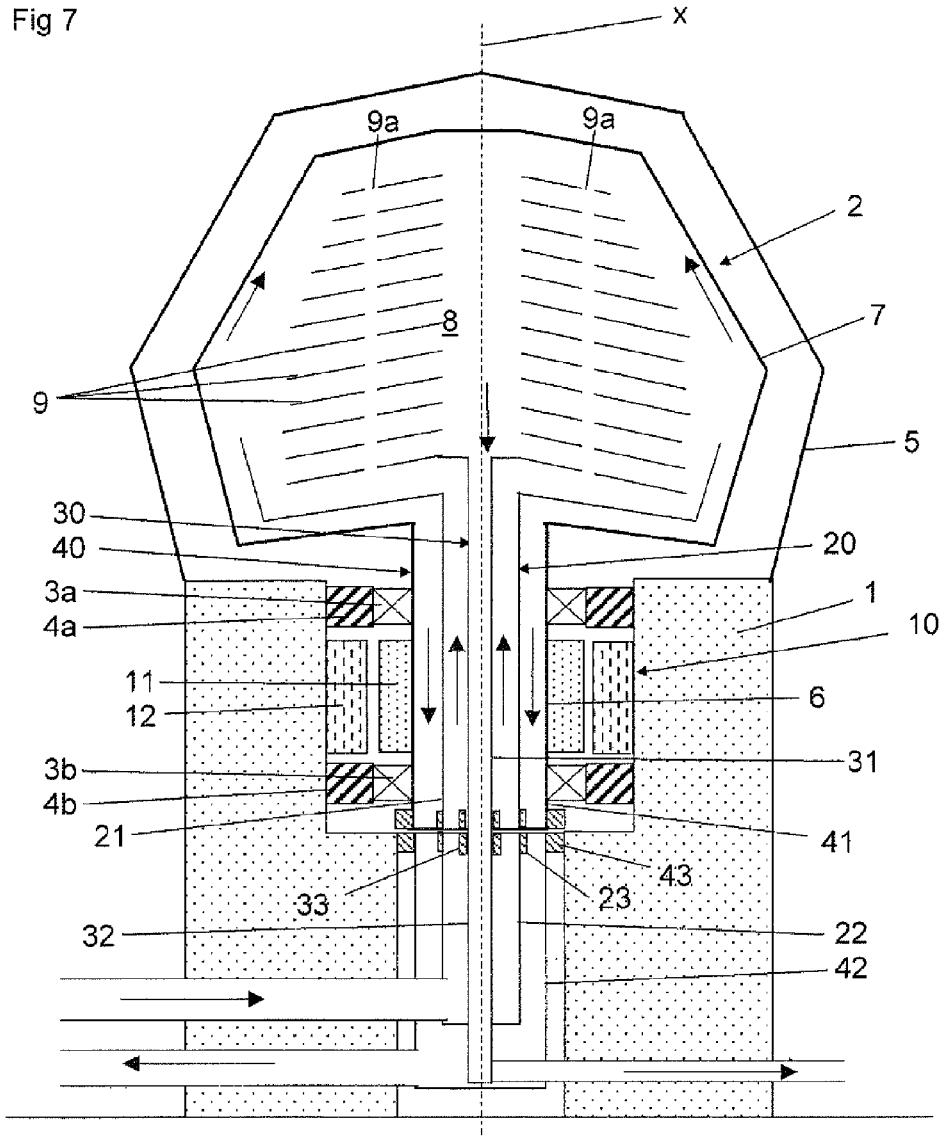
FIG. 7 discloses a centrifugal separator according to a third embodiment of the invention.
Figure 8:
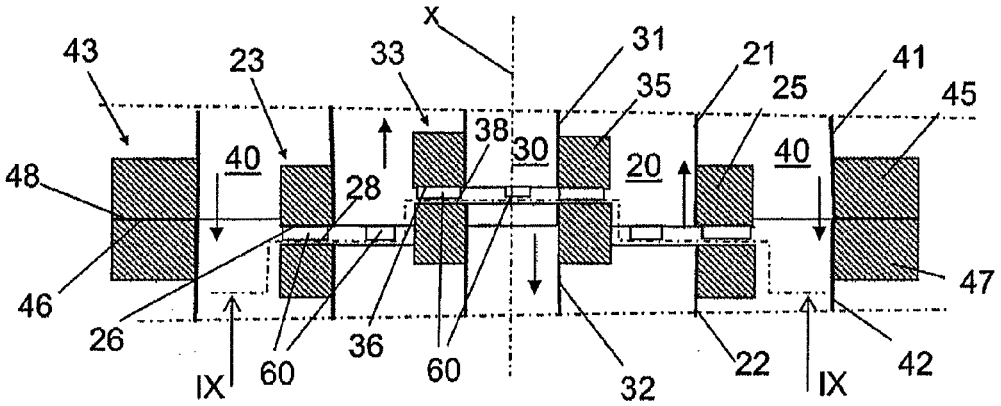
FIG. 8 discloses sealing means of the centrifugal separator in FIG. 7.
Figure 9:
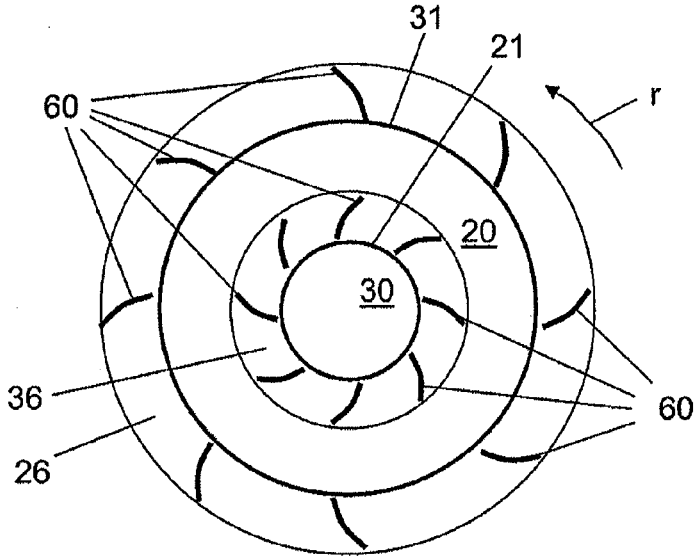
FIG. 9 discloses a view along the line IX-IX in FIG. 8.

FIGS. 7 to 9 disclose a third embodiment of the centrifugal separator, which differs from the one in the first embodiment in that the inlet channel 20 is provided within the further outlet channel 40 along the rotary channel part 21 of the inlet channel 20 and along a substantial part of the frame channel part 21 of the inlet channel 20. The outlet channel 30 is provided within the inlet channel 20 as in the first and second embodiments. Similar to the embodiment of FIG. 2, each channel has a rotary channel part having an inner and outer surface and a frame channel part having an inner and outer surface.

The forcing means are provided to generate a leak flow through the sealing means 23 of the inlet channel 20 from the further outlet channel 40 into the inlet channel 20, thereby preventing leakage from the inlet channel 20 into the further outlet channel 40, and to generate a leak flow through the sealing means 33 of the outlet channel 30 into the inlet channel 20, thereby preventing leakage in the from the inlet channel 20 to the outlet channel 30. Each sealing means contacts an outer surface of the rotary channel part 31 and frame channel part 32.

In the third embodiment, the forcing means comprises pumping elements 60 in the form of blades provided on the rotary seal surface 26 of the inlet channel 26 and the rotary seal surface 36 of the outlet channel 30. The blades on the rotary seal surface 26 and/or the rotary seal surface 36 may of course be replaced by grooves as disclosed in FIG. 4. The blades and/or grooves have the same configuration as the blades disclosed in FIGS. 2 to 4. Also in this case it is possibly to provide the pumping elements 60 on the frame seal surface 28 and/or the frame seal surface 38.

A fourth embodiment of the centrifugal separator differs from the one of the third embodiment in that the pumping elements 60 of the inlet channel 20 on the rotary seal surfaces 26 and/or the pumping elements 60 of the outlet channel 30 on the rotary seal surface 36 have been replaced by a pump wheel 70 of the second embodiment disclosed in FIG. 5. The seal surfaces 26, 28 and/or 36, 38 are arranged at a distance from each to permit the leak flow therethrough.

The present invention is not limited to the embodiments disclosed and described above, but may be varied and modified within the scope of the following claims.

The invention claimed is:

1. A centrifugal separator comprising:

a frame, a rotating part comprising a spindle and a centrifuge rotor enclosing a separation space, the rotating part being supported by the frame to rotate around an axis of rotation, a drive member configured to rotate the rotating part, an inlet channel configured to provide fluid communication into the separation space and comprising a first rotary channel part attached to the centrifuge rotor, the first rotary channel part having an inner surface and an outer surface, a first frame channel part attached to the frame, the first frame channel part having an inner surface and an outer surface, and a first seal provided at the interface between the first rotary channel part of the inlet channel and the first frame channel part of the inlet channel, the first seal contacting the outer surface of the first rotary part and the outer surface of the first frame channel part, and at least one outlet channel configured to provide fluid communication out from the separation space and comprising a second rotary channel part attached to the centrifuge rotor, the second rotary channel part having an inner surface and an outer surface, a second frame channel part attached to the frame, the second frame channel part having an inner surface and an outer surface, and a second seal provided at the interface between the second rotary channel part of the outlet channel and the second frame channel part of the outlet channel, the second seal contacting the outer surface of the second rotary part and the outer surface of the second frame channel part, wherein:

the inlet channel and the outlet channel are arranged adjacent to and concentrically with each other, and a forcing device is provided to generate a leak flow through one of the first and second seals in a first direction from the outlet channel to the inlet channel.

2. The centrifugal separator according to claim 1, wherein the inlet channel is configured to feed a product to be separated into the separation space and the outlet channel is configured to discharge a separated primary phase of the product from the separation space, and wherein the forcing device is provided to generate said leak flow from the outlet channel to the inlet channel and thus to counteract, or prevent, leakage from the inlet channel to the outlet channel.

3. The centrifugal separator according to claim 1, wherein at least said one of the first and second seals comprises a rotary seal surface on the respective rotary channel part and a frame seal surface on the respective frame channel part, and wherein the rotary seal surface and the frame seal surface are arranged opposite to each other.

4. The centrifugal separator according to claim 3, wherein the rotary seal surface and the frame seal surface both extend in parallel with a radial plane with respect to the axis of rotation.

5. The centrifugal separator according to claim 3, wherein the forcing device comprises a plurality of at least partly non-radial pumping elements on at least one of the rotary seal surface and the frame seal surface.

6. The centrifugal separator according to claim 5, wherein the pumping elements have a curved shape seen in the direction of the axis of rotation.

7. The centrifugal separator according to claim 1, wherein the forcing device comprises a pump wheel provided to operate on the outlet channel and arranged to force the fluid communication through the outlet channel, and thus to generate said leak flow.

8. The centrifugal separator according to claim 7, wherein the pump wheel is located upstream of said one of the first and second seals.

9. The centrifugal separator according to claim 1, wherein the spindle comprises the first rotary channel part of the inlet channel and the second rotary channel part of the outlet channel.

10. The centrifugal separator according to claim 1, wherein the drive member comprises an electrical motor having a rotor and a stator, and wherein the rotor is fixedly connected to the rotating part.

11. The centrifugal separator according to claim 1, wherein the outlet channel is provided within the inlet channel.

12. The centrifugal separator according to claim 1, wherein the inlet channel is provided within the outlet channel.

13. The centrifugal separator according to claim 1, wherein the centrifugal separator comprises a further outlet channel configured to provide fluid communication out from the separation space and comprising a third rotary channel part attached to the centrifuge rotor, a third frame channel part attached to the frame, and a third seal provided at the interface between the third rotary channel part and the third frame channel part.

14. The centrifugal separator according to claim 13, wherein the further outlet channel is configured to discharge a separated secondary phase of the product from the separation space, and wherein the forcing device is provided to generate a leak flow through the first seal of the inlet channel from the further outlet channel into the inlet channel and thus to counteract, or prevent, leakage from the inlet channel into the further outlet channel.

15. The centrifugal separator according to claim 13, wherein the outlet channel is provided within the inlet channel, wherein the inlet channel is provided within the further outlet channel at least at the interface between the first rotary channel part of the inlet channel and the first frame channel part of the inlet channel, and wherein the forcing device is provided to generate a leak flow through the first seal of the inlet channel from the further outlet channel into the inlet channel and thus to counteract, or prevent, leakage from the inlet channel into the further outlet channel.

16. A centrifugal separator according to claim 2, wherein at least said one of the first and second seals comprises a rotary seal surface on the respective rotary channel part and a frame seal surface on the respective frame channel part, and wherein the rotary seal surface and the frame seal surface are arranged opposite to each other.

17. The centrifugal separator according to claim 4, wherein the forcing device comprises a plurality of at least partly non-radial pumping elements on at least one of the rotary seal surface and the frame seal surface.

18. A centrifugal separator comprising:

a frame;

a spindle and a centrifuge rotor enclosing a separation space, the spindle being supported by the frame to rotate around an axis of rotation;

a fluid channel having concentric channels comprising:

an inlet channel comprising a first rotary channel part and a first frame channel part;

a first seal provided at the interface between the first rotary channel part and the first frame channel part;

an outlet channel comprising a second rotary channel part and a second frame channel part; and a second seal provided at the interface between the second rotary channel part and the second frame channel part of the outlet channel, wherein the first seal is within the outlet channel and contacts an outer surface of the first frame channel part, and a forcing device provided to generate a leak flow through the first seal in a radial direction from the outlet channel to the inlet channel.

19. The centrifugal separator according to claim 18, wherein the second seal contacts an outer surface of the second frame channel part.

* * * * *